United States Patent [19]

Rossebo

[11] Patent Number: 5,040,393

[45] Date of Patent: Aug. 20, 1991

[54] DOOR LOCK MODULE

[76] Inventor: Conrad Rossebo, 1881 Granite Hills Dr., El Cajon, Calif. 92019

[21] Appl. No.: 468,169

[22] Filed: Jan. 22, 1990

Related U.S. Application Data

[63] Continuation-in-part of Ser. No. 341,589, Apr. 21, 1989, abandoned.

[51] Int. Cl.[5] ..... E05B 9/08

[52] U.S. Cl. ..... 70/370; 70/450; 70/451; 292/337; 292/DIG. 53

[58] Field of Search ..... 70/451, 452, 370, 448, 70/450; 292/DIG. 53, DIG. 64, 337, 356, 357

[56] References Cited

U.S. PATENT DOCUMENTS

| | | | |
|---|---|---|---|
| 926,336 | 6/1909 | Keil | 70/451 |
| 1,483,333 | 2/1924 | Capece | 70/452 |
| 2,091,248 | 8/1937 | Schlage | 70/451 |
| 2,200,387 | 5/1940 | Evath | 70/451 |
| 2,568,273 | 9/1951 | Clark | 70/451 |
| 4,002,361 | 1/1977 | Laufenburg | 292/DIG. 53 X |
| 4,139,999 | 2/1979 | Allenbaugh | 70/452 |
| 4,182,528 | 1/1980 | Klay | 70/451 X |
| 4,236,396 | 12/1980 | Surko, Jr. et al. | 70/451 X |

*Primary Examiner*—Lloyd A. Gall

*Attorney, Agent, or Firm*—F. X. Lojacono

[57] ABSTRACT

A modular door lock apparatus having a mainframe defined by a front face plate and an outer and inner side plate extending rearwardly of said front face plate a latch assembly being fixedly mounted to said front face plate, so as to be positioned between the side plates. A key cylinder is secured to the outer side plate and a latch knob is mounted to the inner side plate so as to operate the latch bolt of the latch assembly. The door lock apparatus is secured to the door by sliding the apparatus into a central bore and adjacent longitudinal slots that are formed in the leading edge of the door. The apparatus is then secured to the door by means of a pair of transversely positioned screws that are received through the oppositely disposed slots having their threaded ends extending outwardly of the outer side plate to engage the key cylinder. The screws may also be provided with nuts, which are fixedly positioned against the outer side plate. This allows the side plates to be forced against the outer sides of the door in a vise-like clamping arrangement as the screws are tightened. With the heads of the screws being positioned on the inner side of the door, the door lock apparatus can not be removed therefrom without the door being moved to an open position.

5 Claims, 1 Drawing Sheet

FIG. 1
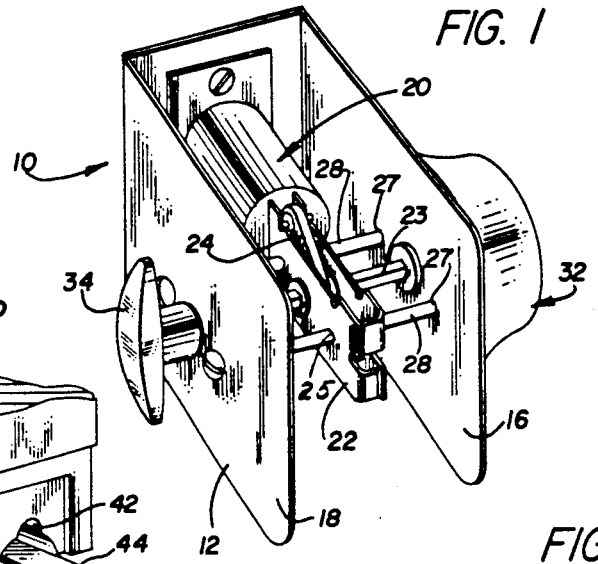
FIG. 6
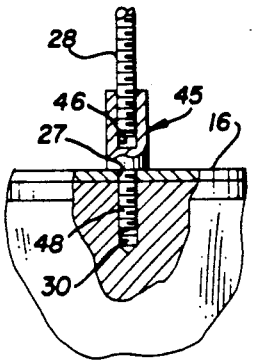
FIG. 2
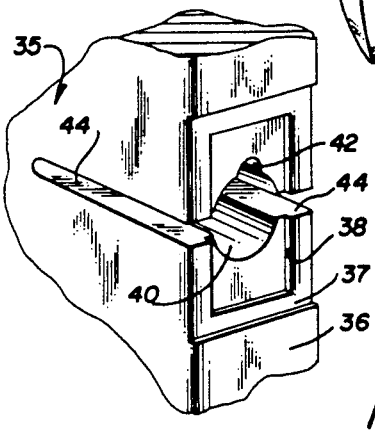
FIG. 3
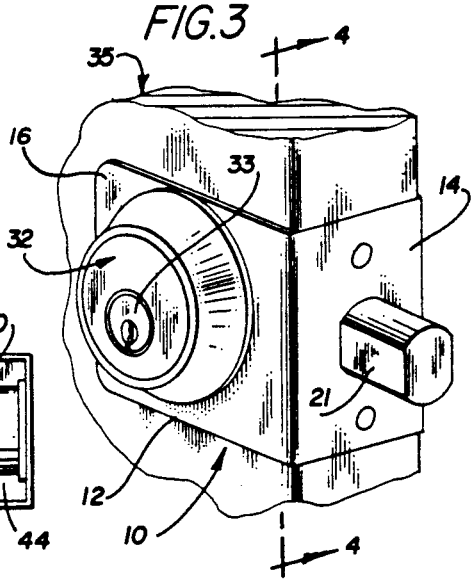
FIG. 5
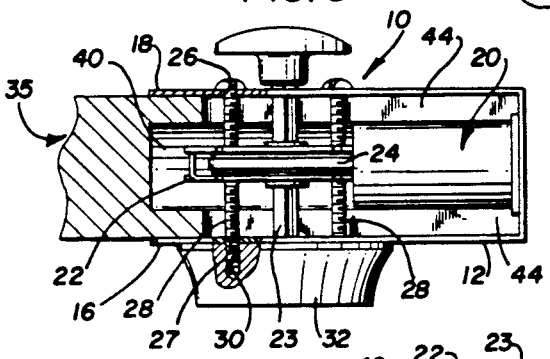
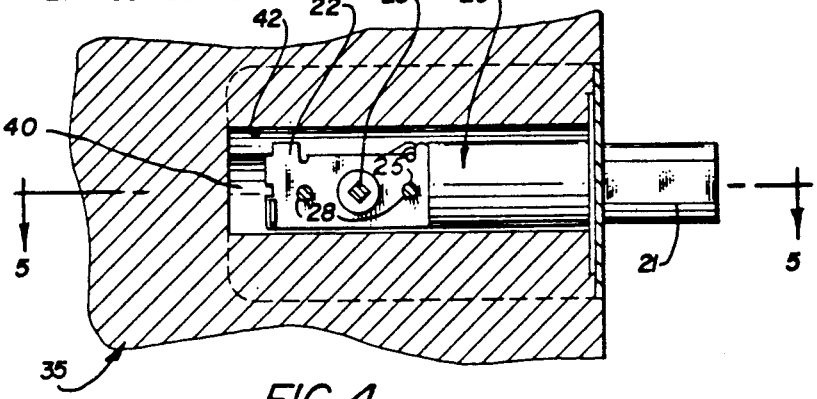
FIG. 4

DOOR LOCK MODULE

This application is a continuation-in-part of the parent application having the same inventor, Conrad Rossebo, Ser. No. 07/341,589 filed 04/21/89 now abandoned.

BACKGROUND OF THE INVENTION

1. Field of the Invention

The present invention relates generally to door locks, and more particularly to a door lock apparatus having a novel mounting arrangement wherein the mainframe structure of the apparatus is employed as part of the securing means thereof.

1. Description of the Prior Art

As is well known in the art, various problems and difficulties are encountered in providing a suitable door lock device that allows one to readily change a door lock mounted in a door in a very efficient manner and with ease, without the need of assembling the lock device or the need of serveral tools for mounting same.

Many types of door locks are in use today, each having its particular design and mounting arrangement. For this reason, it becomes a problem when there is a need to repeatedly change door locks, as is often the case in large rental complexes. Most known door locks do not lend themselves to such operations since these devices have various limitations that restrict their use under such conditions. Often they are complicated in structure and thus are time consuming to install. Moreover, the average lock unit is not only expensive but costly to maintain as well.

In the past, door locks (excluding striker assemblies) have come in four parts: latch or bolt assembly; exterior cylinder assembly, which is designed to receive a key; latch operation knob or the handle mounted on the interior of the door; and mounting screws designed to secure individual parts to the door. Thus, to accommodate these parts, the material must be removed from the door by drilling, chiseling, or cutting.

When a lock has an externally mounted cylinder, it requires the changing of all the individual parts. That is, the lock must be disassembled and new parts reinstalled. This is time-comsuming, costly, and requires a degree of skill that is not common to the average manager or homeowner. The need for security in our crime-ridden society has prompted many cities to establish statutes that require owners of rental units to change locks every time an old tenant moves out or a new tenant moves in. If a master key for a large apartment complex falls into the wrong hands, every lock on the property must be changed or remastered.

The following are patent references cited in the original filed application.

U.S. Pat. No. 640,217 to Moore
U.S. Pat. No. 926,336 to Keil
U.S. Pat. No. 2,200,387 to Erath
U.S. Pat. No. 3,673,605 to Allenbaugh
889,738 Canada
U.S. Pat. No. 898,748 to Keil
U.S. Pat. No. 1,483,333 to Capece
U.S. Pat. No. 3,257,136 to Russell et al
261,865 Great Britain
2,415,709 France

OBJECTS OF THE INVENTION

It is an object of the present invention to provide a door lock apparatus that has a single lock assembly and is readily installed in a door structure which is slotted to receive the apparatus as a modular unit. After the door lock assembly is in position, the two securing screws, located on the mainframe of the lock, are securely tightened, whereby the side jaw members of the mainframe are clamped tightly against the outer respective side surfaces of the door.

Still another object of the invention is to provide a door lock apparatus wherein the mainframe forms part of the securing means defined by oppositely disposed vise-like jaws members which, when squeezed together, secure the lock assembly in a fixed position within the door structure, and thus can not be removed until the exposed screws on the inner side of the mainframe are loosened.

It is still another object of the present invention to provide a door lock of this character that can be installed or changed in less time and with a great deal less difficulty than with known existing locking units.

A further object of the present invention is to provide a novel method of preparing the door by forming a horizontal slot inwardly of the leading edge of the door, whereby the modular lock assembly is inserted in the slot and simply secured by a pair of transversely positioned screws.

SUMMARY OF THE INVENTION

The present invention consists of a preassembled lock assembly wherein the component parts of the lock are fixedly mounted to a bracket or mainframe. The mainframe is formed having a substantially U-shaped configuration that is defined by a face plate and oppositely disposed side plate members, wherein the side plate members provide a jaw-like clamping means. The side members are clamped against the respective sides of the door by a pair of screws that are positioned transversely across from one side jaw member to the other so as to threadably engage the key lock cylinder. By tightening each screw, the side jaw members are forced inwardly, thereby clamping the door therebetween. To mount the lock assembly, the front or leading edge of the door is recessed to receive the plate member of the mainframe and a longitudinal bore is made with oppositely disposed slots formed therewith allow the clamping screws to readily extend transversely from one side to the other. The outer side of the lock assembly includes the key lock cylinder with the inner side of the assembly having a latch knob for manual locking and unlocking. As in most locking devices, the lock assembly can not be removed unless the door is in an open position.

BRIEF DESCRIPTION OF THE DRAWINGS FIGURES

With the above and related objects in view, the invention consists in the details of construction and combination of parts, as will be more fully understood from the following description, when read in conjuction with the accompanying drawings and numbered parts in which:

FIG. 1 is rear perspective view of the present invention showing all of the preassembled component parts thereof;

FIG. 2 is a perspective view of the cut-out portion of the leading edge of the door wherein the lock is to be mounted;

FIG. 3 is a front perspective view of the lock assembly mounted in the door;

FIG. 4 is a cross-sectional view taken substantially along line 4—4 of FIG. 3;

FIG. 5 is a cross-sectional view taken substantially along line 5—5 of FIG. 4 showing the side jaw members clamped in a secured position against the sides of the door and the latch bolt in a retracted position from that shown in FIG. 4; and FIG. 6 is an enlarged sectional view of an alternative securing means wherein a securing nut is interposed between the transverse screw and the key lock member.

DETAILED DESCRIPTION OF THE INVENTION

Referring more particularly to FIG. 1, there is shown a perspective view of the preferred embodiment of the present invention which defines a modular door lock apparatus, generally indicated at 10. The door lock apparatus comprises a mainframe or bracket 12 that is formed having a substantially U-shaped configuration and includes a front face plate 14 and a pair of side plate members 16 and 18. Side plate 16 will also be referred to as the outer plate, and the oppositely positioned side plate 18 will be referred to as the inner plate. The arrangement of the oppositely positioned plates provides a jaw-like clamping means which will be discussed hereinafter in more detail. Fixedly mounted to the inner side of face plate 14 is a latch assembly, generally indicated at 20. The latch assembly extends rearwardly of face plate 14 and is interposed between the two side plates 16 and 18, as seen in FIGS. 1 and 5. Latch assembly 20 includes a slidable latch bolt 21 and a bracket arm 22 which is arranged to support latch rod 23 and latch throw arm 24. Bracket arm 22 includes aligned holes 25 that correspond to holes 26 and 27 disposed in the inner and outer side plates 18 and 16 respectively, as indicated in FIG. 5. Screw pins 28 are mounted through holes 26 of inner plate 18 and extend transversely through bracket 22 at holes 25 and then through holes 27 as provided in outer plate 16. Each screw or threaded pin 28 is received into threaded holes 30 normally found in a key lock cylinder, generally at 32. The screws also help to mount lock cylinder 32 to outer plate 16. As is typical, lock cylinder 32 includes a key cylinder 33. Latch rod 23 connects to the lock assembly 32, and extends through the inner plate 18 whereby knob 34 is attached to rod 23 in a well known manner.

To accommodate door lock assembly 10, the door, designated at 35, must be formed having corresponding recesses to receive assembly 10. Accordingly, FIG. 2 illustrates how the recesses are arranged therein. That is, the front or leading edge 36 of door 35 is cut having a first recess 37 and counter recess 38 so as to receive face plate 14 of main frame 12. A center bore 40 together with a keyway 42 are longitudinally positioned relative to recess 37. This configuration is adapted to receive latch assembly 20 and bracket 22, as illustrated in FIGS. 4 and 5. Side slots 44 are formed in the opposite side of door 35. These slots allow screw pins 28 and latch rod 23 to be received and mounted to the door by simply sliding the complete lock assembly onto the door.

Once lock assembly 10 is in place, as seen in FIGS. 3, 4, and 5, screws 28 are tightened, causing the side plates 16 and 18 to grasp the respective inner and outer surfaces of the door, as more particularly illustrated in FIG. 5. This arrangement provides a vise-like clamping means whereby the lock assembly is secured in place and it can not be removed unless the door is in an open position, which is not the case with almost all known lock units that are presently in use at this time.

Referring now to FIG. 6, there is shown an alternative arrangement of securing screw 28 to key lock 32. In this arrangement key lock 32 is first secured to outer side plate 16 by means of a fastening nut 45. Nut 45 is formed having an internal threaded recess 46 so as to receive screw 28 after nut 45 is secured by threaded pin member 48 in threaded bore 30 located in the body of key lock 32.

It may be thus seen that the objects of the present invention set forth herein, as well as those made apparent from the foregoing description are efficiently attained. While preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What I claim is:

1. A modular door lock apparatus comprising:

a mainframe member having a front face plate;

a pair of oppositely disposed side plates integrally formed with said front face plate and extending rearwardly thereof whereby said side plates engage the opposite sides of a door;

clamping means formed as part of said mainframe member whereby said apparatus is quickly secured to, or removed from, the door;

a latch assembly fixedly mounted to said front face plate of said mainframe member;

a cylinder lock assembly mounted to one side plate of said mainframe member;

a knob operably connected to said cylinder lock assembly by means of an interconnecting rod;

a pair of screws transversely mounted between said side plates and secured to said cylinder lock assembly;

wherein said clamping means comprises:

said pair of side plates defined an outer side plate and an inner side plate integrally formed with said front face plate;

said pair of screws mounted to said mainframe member and extending transversely therethrough, pass through a slot formed inwardly from the leading edge of a door, to project outwardly of said outer side plate, wherein said cylinder lock assembly is attached to said mainframe member, whereby the tightening of said screws forcibly clamp said side plates against the respective sides of the door, thereby securing said apparatus to said door in a vise-like manner.

2. A modular door lock apparatus as recited in claim 1, wherein said mainframe member is formed having a substantially U-shaped configuration defined by said front face plate, and said inner and outer side plates.

3. A modular door lock apparatus as recited in claim 1 wherein said screws include a nut member securable to said cylinder lock assembly whereby said cylinder lock assembly is secured to said outer side plate.

4. A door lock apparatus in combination with a door, said door being formed having a center bore and a pair of longitudinal slots positioned on both sides thereof, said bore and said slots being formed inwardly of the leading edge of said door, wherein said door lock apparatus comprises:

a latch assembly;

a key-operated cylinder;

a latch operator knob, wherein said key cylinder and said latch knob are operably connected to said latch assembly by means of a rod;

a mainframe defined by a front face plate having an inner side plate and an outer side plate, wherein said latch assembly is secured to said front face plate, and wherein said key cylinder is mounted to said outer side plate and said latch knob is positioned on said inner side plate; and means positioned between said inner and outer side plates for clamping said door lock apparatus to said door, whereby said door lock apparatus can not be removed therefrom without releasing said clamping means;

wherein said clamping means comprises at least one threaded screw mounted to said mainframe and extending transversely through said latch assembly and said longitudinal slots of said door so as to project through said outer side plate to receive said key cylinder thereon, whereby said side plates are forcibly clamped against the respective outer surfaces of said door by means of said at least one screw.

5. The combination as recited in claim 4 wherein said inner and outer side plates define jaw-like members, and said clamping means comprises a pair of screws mounted to said mainframe, said screws being provided with nut members mounted to said outer side plate and attached to said key cylinder, whereby said apparatus can be quickly secured to, or removed from, said door.

* * * * *